US008075094B2

(12) United States Patent
Shimomura et al.

(10) Patent No.: US 8,075,094 B2
(45) Date of Patent: Dec. 13, 2011

(54) LIQUID EJECTION HEAD AND PROCESS FOR PRODUCING THE SAME

(75) Inventors: Masako Shimomura, Yokohama (JP); Hiromichi Noguchi, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/498,842

(22) Filed: Jul. 7, 2009

(65) Prior Publication Data

US 2010/0007698 A1 Jan. 14, 2010

(30) Foreign Application Priority Data

Jul. 9, 2008 (JP) ..... 2008-178988

(51) Int. Cl.
*B41J 2/135* (2006.01)

(52) U.S. Cl. ..... 347/45; 427/553; 427/554

(58) Field of Classification Search ..... 347/20, 347/44, 45; 427/532, 553, 554, 457
See application file for complete search history.

(56) References Cited

U.S. PATENT DOCUMENTS

| | | | | |
|---|---|---|---|---|
| 5,755,867 | A * | 5/1998 | Chikuni et al. | 106/287.16 |
| 6,540,330 | B1 | 4/2003 | Kubota | |
| 6,830,785 | B1 * | 12/2004 | Hayakawa et al. | 427/553 |
| 7,294,365 | B2 * | 11/2007 | Hayakawa et al. | 427/553 |
| 2004/0265506 | A1 * | 12/2004 | Hirai et al. | 427/532 |
| 2007/0085877 | A1 | 4/2007 | Ohkuma | |

* cited by examiner

*Primary Examiner* — Huan Tran

(57) ABSTRACT

An aspect of the present invention is a process for producing a liquid ejection head including an ejection orifice member provided with ejection orifices for ejecting liquid. The process includes supplying to a surface of a base material for forming the ejection orifice member a mixture of a first composite for imparting a hydrophobic characteristic to the surface and a second composite being able to exhibit a hydrophilic characteristic by being irradiated with light; imparting a hydrophobic characteristic to the entire or a part of the surface by utilizing the first composite; and then irradiating the second composite with light in a partial region of the surface for imparting a hydrophilic characteristic to the region irradiated with the light.

7 Claims, 7 Drawing Sheets

LIQUID EJECTION HEAD AND PROCESS FOR PRODUCING THE SAME

BACKGROUND OF THE INVENTION

1. Field of the Invention

The present invention relates to a liquid ejection head for ejecting liquid and a process for producing the head. Specifically, the invention relates to an ink-jet recording head for conducting recording by ejecting ink onto a recording medium and relates to a process for producing the head.

2. Description of the Related Art

As an example of surface treatment of the face surface of an ink-jet head, U.S. Pat. No. 6,540,330 discloses a technique in which titanium oxide having photocatalytic activity is disposed on the face surface of an ink-jet head (hereinafter referred to as IJ head).

U.S. Pat. No. 6,540,330 relates to an IJ head having a passage configured by stacking two Si substrates. This IJ head is produced by forming a Ti compound (amorphous titania) on an orifice plate made of a Si substrate and then baking it at 400 to 500° C. The baking at a high temperature changes the Ti compound to anatase type titanium oxide. Therefore, the titanium oxide generated on the face surface is changed to be superhydrophilic by being irradiating with UV light, resulting in inhibition of adhesion of ink. As an additional effect, it is disclosed that the UV light decomposes the ink adherent. The IJ head disclosed in U.S. Pat. No. 6,540,330 has such a self-cleaning function, but the IJ head must be produced with an inorganic material because of the baking at a high temperature. Therefore, since the process and the material thereof are thus limited, it is concerned that it may be difficult to inexpensively produce the IJ head having high resolution.

US patent Publication No. 2007/0085877 discloses an IJ head having a hydrophobic layer that is composed of a hydrolyzable silane condensate including fluorine and a cation polymerizable functional group. This IJ head is produced by a photolithographic process, and it is supposed that the hydrophobic surface composed of a condensate of a silane compound is hard and is also excellent in blade durability. In addition, in US patent Publication No. 2007/0085877, it is disclosed that a partial hydrophobic region is provided by not imparting a hydrophobic characteristic to the region. Recently, various types of ink are used for ejection, and, thereby, further diversification of the face surface of the ejection orifice is required.

SUMMARY OF THE INVENTION

The present invention provides a liquid ejection head having a diversified ejection orifice face surface.

An aspect of the present invention is a process for producing a liquid ejection head having an ejection orifice member provided with ejection orifices for ejecting liquid. The process includes supplying to a surface of a base material for forming the ejection orifice member a mixture of a first composite for imparting a hydrophobic characteristic to the surface and a second composite being able to exhibit a hydrophilic characteristic by being irradiated with light, imparting a hydrophobic characteristic to the entire or a part of the surface by utilizing the first composite, and then irradiating the second composite with light in a partial region of the surface for imparting a hydrophilic characteristic to the region irradiated with the light.

Further features of the present invention will become apparent from the following description of exemplary embodiments with reference to the attached drawings.

DESCRIPTION OF THE EMBODIMENTS

Figure 1:
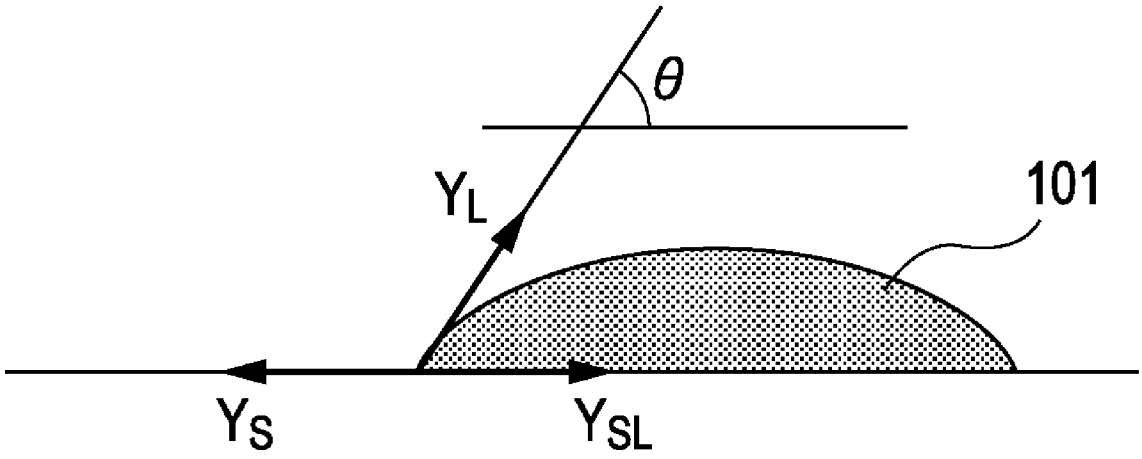
FIG. 1 is a diagram illustrating a concept of a contact angle.

In an aspect of the present invention, a face surface treatment composite containing photocatalytic particles is applied to an ejection orifice face surface, and then patterning by a photolithographic process is performed to form a face surface treatment layer. The photolithographic process by photo-patterning is superior to a process using, for example, a laser, as a manufacturing process that is possible to perform precise microfabrication and has high productivity. The photo-patterning is a process for forming a (negative) pattern by placing a mask on an applied material, irradiating the mask with light for curing the portion irradiated with the light, and removing the uncured portion by developing or a process for forming a (positive) pattern by placing a mask, irradiating the mask with light for breaking the bond at the portion irradiated with light, and performing development for removing.

The IJ head according to the present invention can be readily produced by the photolithographic process. Furthermore, since the surface of the IJ head is provided with a face surface treatment layer having a photocatalytic function, foreign substances adhering to the face surface treatment layer and causing printing defects can be decomposed by irradiating the layer with light having a specific wavelength emitted from a lamp disposed in a printer. The photocatalytic particles that impart the photocatalytic function to the face surface treatment layer may be composed of, for example, titanium oxide. Since titanium oxide activated by light irradiation can decompose foreign substances, the superhydrophilic properties of the face surface can be maintained over a long time.

The present invention will be described further in detail below.

Photocatalytic Particles

The photocatalytic particles are those that exhibit a photocatalytic function by being irradiated with light having a wavelength corresponding to an energy greater than the band gap thereof. The photocatalytic function oxidatively decomposes an organic substance being in contact with the particles that are excited by irradiation with light to generate OH radicals from the moisture in the atmosphere. Therefore, the photocatalytic particles can oxidatively decompose the organic substance adhering to the surfaces thereof by the photocatalytic activity. In addition, the exposure of the photocatalytic particles to UV light generates hydroxyl groups on the surfaces of the photocatalytic particles, which allows holding absorbed water, resulting in superhydrophilic surfaces. This inhibits foreign substances from adhering to the face surface. It is thought that this is caused by the fixation of hydroxyl groups to the surfaces due to the excitation. Even if the adhesion occurs, since the face surface that is provided with the superhydrophilic characteristic is excellent in wiping properties, the adhering substances can be readily removed by wiping with a blade. Therefore, in the IJ head of the present invention, since the face surface contains the photocatalytic particles, even if the face surface of the IJ head is contaminated during storage or use for a long period of time, the face surface can be cleaned by UV light irradiation.

Examples of the photocatalytic particles include titanium oxide, zinc oxide, tungsten oxide, iron oxide, strontium titanate, and mixtures of two or more thereof. The term "titanium oxide" in this specification includes, in addition to titanium dioxide ($TiO_2$), those that are generally called aqueous titanium oxide, hydrated titanium oxide, metatitanic acid, orthotitanic acid, and titanium hydroxide, and the crystal forms thereof are not limited. The photocatalytic particles can be composed of titanium oxide, which has a high photocatalytic function and is chemically stable and harmless. The titanium oxide can be titanium dioxide. In the case of titanium dioxide, Ti atoms are bonded to one another via oxygen atoms, and it is thought that a hydroxyl group is bonded to each Ti atom when the photocatalytic function is induced.

Furthermore, the insides or the surfaces of the photocatalytic particles may contain, as a second component, at least one metal or a compound of the metal selected from the group consisting of V, Fe, Co, Ni, Cu, Zn, Ru, Rh, Pd, Ag, Pt, and Au. By doing so, a higher photocatalytic function can be exhibited. Examples of the metal compound include oxides, hydroxides, oxohydroxides, sulfates, halides, and nitrates of the metal and metal ions. The content of the second component is properly determined depending on the compound. The content of the photocatalytic particles can be 5 to 98% as the total amount of the photocatalytic particles and a dispersant for the photocatalytic particles. In a photocatalytic particle content lower than this range, the photocatalytic function may be too low as a photocatalyst.

The photocatalytic particles can be obtained by the following process: titanium oxide is prepared, for example, by (i) thermal hydrolysis of a titanium compound, such as titanyl sulfate, titanium chloride, or titanium alkoxide, in the presence of seed nuclei as necessary; (ii) neutralization of a titanium compound, such as titanyl sulfate, titanium chloride, or titanium alkoxide, with an alkali, in the presence of seed nuclei as necessary; (iii) vapor-phase oxidation of, for example, titanium chloride or titanium alkoxide; or (iv) baking or hydrothermal treatment of the titanium oxide prepared in the process (i) or (ii). In particular, the titanium oxide prepared by the process (i) or (iv) can exhibit a high photocatalytic function.

The second component can be contained in the insides or the surfaces of the photocatalytic particles by, for example, by adding the second component during the manufacturing of the photocatalytic particles for adsorption. Alternatively, the second component may be added after the manufacturing of the photocatalytic particles for adsorption and being heated or reduced as necessary.

Hydrolyzable Silane Compound Having Polymerizable Group

An example of the hydrolyzable silane compound having polymerizable group(s) used in the present invention is a hydrolyzable silane compound having cation polymerizable group(s). Other examples include groups for radical polymerization or anion polymerization.

The hydrolyzable silane compound having cation polymerizable group(s) (functional group having cation-polymerizing ability) used in the present invention can form a condensation-crosslinking film having high durability due to an inorganic bond by hydrolysis and an organic bond by the cation polymerizable group. In addition, since the compound includes the cation polymerizable group at the inside thereof, it is a photosensitive material that can be photo-patterned by pattern exposure. The pattern can be formed by providing a predetermined mask on a condensation film of the hydrolyzable silane compound having cation polymerizable group(s), performing light irradiation for activating a cationic photopolymerization initiator to induce polymerization reaction for curing the portion irradiated with the light, and removing the uncured portion by development.

The hydrolyzable silane compound having cation polymerizable group(s) is a silane compound having at least one cation polymerizable group and at least one hydrolyzable group. Examples of the hydrolyzable silane compound having cation polymerizable group(s) include compounds represented by the following Formula (1):

$$(R1)_p Si(X)_{4-p} \quad (1)$$

In Formula (1), each R1 independently represents a cation polymerizable group, each X independently represents a hydrolyzable group, and p represents an integer of 1 to 3.

The cation polymerizable group R1 is a functional group having cation-polymerizing ability. By using the hydrolyzable silane compound having such a functional group, the face surface treatment layer can be formed by a photolithographic process. Furthermore, a strong face surface treatment film can be provided with higher durability by forming a bond by the cationic polymerization, in addition to the siloxane bond by the condensation. That is, both curing reaction (condensation reaction) due to the silanol group and curing reaction (polymerization reaction) due to the cation polymerizable group can be induced simultaneously.

Examples of the cation polymerizable group R1 include organic groups having cyclic ether structures and organic groups having vinyl ethers, and the cation polymerizable group R1 can be preferably an organic group having a cyclic ether structure. Examples of the cyclic ether group include those having cyclic ether structures of three to six-membered rings having a linear or cyclic structure. More specifically, the examples include groups having structures containing an epoxy group, an oxetane group, or a tetrahydrofuran or pyran unit. The cyclic ether group can be an epoxy group or an oxetane group. In particular, when a passage-forming layer (nozzle plate) is configured of an epoxy resin, the cation polymerizable group can be an epoxy group from the viewpoint of adhesion with the passage-forming layer.

The hydrolyzable group X can generate a silanol group by hydrolysis and then form a siloxane bond by condensation. In general, the hydrolysis is carried out by heating at the temperature range of from room temperature (25° C.) to 100° C. under catalyst-free conditions in the presence of excess water. Examples of the hydrolyzable group X include a hydrogen atom, alkoxy groups, halogen atoms, amino groups, and acyloxy groups. The hydrolyzable group X can be an alkoxy group, in particular, an alkoxy group having one to three carbon atoms. Examples of the alkoxy group having one to three carbon atoms herein include a methoxy group, an ethoxy group, and a propoxy group. Among the alkoxy groups having one to three carbon atoms mentioned above, the ethoxy group and the propoxy group are preferred from the viewpoint of storage stability. Since these alkoxy groups are readily hydrolyzed to generate silanol groups, photocuring reaction can be stably induced.

More specifically, examples of the hydrolyzable silane compound having cation polymerizable group(s) used in the present invention include glycidoxypropyltriethoxysilane, glycidoxypropyltrimethoxysilane, glycidyloxypropyltrimethoxysilane, glycidyloxypropyltriethoxysilane, epoxycyclohexylethyltrimethoxysilane, and epoxycyclohexylethyltriethoxysilane.

Furthermore, p in Formula (1) can be 1, that is, the hydrolyzable silane compound can have three hydrolyzable groups for giving a highly polymerized compound in the condensation.

Furthermore, after the hydrolysis of the hydrolyzable silane compound having cation polymerizable group(s), a part of the hydrolyzable groups may remain without being hydrolyzed. In such a case, the resulting product is a mixture of the hydrolyzable silane compound having cation polymerizable group(s) and hydrolysates thereof. In addition, the hydrolysates of the hydrolyzable silane compound having cation polymerizable group(s) include not only compounds having silanol groups obtained by the hydrolysis of the hydrolyzable groups (for example, alkoxy group) but also partially condensed compounds obtained by the condensation of a part of the silanol groups. Furthermore, it is not necessary that the hydrolyzable silane compound having cation polymerizable group(s) has been hydrolyzed at the time that a cationic photopolymerization initiator is blended, as long as at least part of the hydrolyzable groups has been hydrolyzed at the time of light (UV light) irradiation. After the condensation, a siloxane compound having cation polymerizable group(s) is obtained.

Polymerization Initiator

The polymerization initiator used in the present invention can provide polymerization-active species, such as cations, radicals, or anions, to a compound having polymerizable group(s).

Any cationic photopolymerization initiator can be used without particular limitation, and examples thereof include onium salts, sulfone salts, halogen-containing compounds, quinone diazide compounds, sulfone compounds, sulfonic acid compounds, and nitrobenzene compounds.

In the compounds above, aromatic onium salts are more effective, and an example of such onium salts is a diaryliodonium salt.

The content ratio of the cationic photopolymerization initiator is not particularly limited and, in general, can be in the range of 0.1 part by mass or more and 15 parts by mass or less based on 100 parts by mass of the hydrolyzable silane compound having cation polymerizable group(s). When the amount of the cationic photopolymerization initiator is lower than 0.1 part by mass, the curability may be too low to give a sufficient curing rate. On the other hand, when the amount of the cationic photopolymerization initiator is greater than 15 parts by mass, the weather resistance and the heat resistance of the cured product may be insufficient. Accordingly, from the viewpoint of balance between curability and, for example, weather resistance of the cured product, the amount of the cationic photopolymerization initiator can be in the range of 1 to 10 parts by mass based on 100 parts by mass of the hydrolyzable silane compound having cation polymerizable group(s).

Examples of the exposure ray for decomposing the cationic photopolymerization initiator to generate cations include visible light, UV light, infrared light, X-ray, α-ray, β-ray, and γ-ray. The exposure ray can be UV light, which has a certain energy level and can give a high curing rate and also has an advantage that a relatively inexpensive and small-sized irradiation apparatus can be used.

Face Surface Treatment Composite

In an example of the face surface treatment composite in the present invention, at least the photocatalytic particles, the hydrolyzable silane compound having polymerizable group(s), and the polymerization initiator are contained. The face surface treatment layer is formed by applying the face surface treatment composite to a base material such as a passage-forming layer (nozzle plate) and curing the applied composite.

More specifically, for example, the face surface treatment layer can be formed by applying the face surface treatment composite to the face surface of an IJ head, then irradiating the composite with UV light to generate cations, and inducing polymerization of the hydrolyzable silane compound having cation polymerizable group(s). This face surface treatment layer contains the photocatalytic particles and thereby exhibits a self-cleaning function by UV light irradiation. In addition, a predetermined pattern can be formed in the face surface treatment layer by using a predetermined mask in the light irradiation for curing the light irradiation portion and removing the unirradiated portion by development. The face surface treatment composite according to the present invention has negative-type photosensitivity.

Furthermore, the face surface treatment layer according to the present invention has a hydrophobic characteristic due to the properties of a silane compound. In addition, since the layer contains the photocatalytic particles (for example, titanium oxide) in the inside, the portion irradiated with UV light can be changed to be hydrophilic. In the case of not being irradiated with light, it is not limited, but a hydrophobic characteristic of a contact angle of about 90° can be provided. The UV light irradiation portion can be provided with a hydrophilic characteristic of a contact angle of less than 20°. Therefore, any region of the face surface can be readily provided with a hydrophilic characteristic by using a mask in the UV light irradiation. When the hydrophilic characteristic is deteriorated during the time of storage, it can be recovered by reirradiation. The hydrophobic characteristic can be properly adjusted by changing the composition of the face surface treatment composite.

In the face surface treatment layer of the present invention, the face surface may be provided with a hydrophilic characteristic by the activation of the photocatalytic particles by UV light irradiation for inducing cationic polymerization. However, the hydrophilic characteristic of the face surface is lost through various steps, such as mounting, for producing the IJ head and the course of logistics, and the face surface exhibits the properties (hydrophobic characteristic) of the silane compound. Therefore, a desired portion needs to be provided with a hydrophilic characteristic by UV light irradiation using, for example, a UV lamp installed to the inside of a printer.

Furthermore, the hydrolyzable silane compound having cation polymerizable group(s) may be subjected to hydrolysis and dehydration condensation in advance for being partially oligomerized or polymerized.

Other Additives

The face surface treatment composite may contain, in addition to the photocatalytic particles, the hydrolyzable silane compound having cation polymerizable group(s), and the cationic photopolymerization initiator, a resin or a monomer (for example, an epoxy resin, an epoxy monomer, or an epoxy oligomer) that can polymerize with the cationic photopolymerization initiator, a solvent, a surfactant, an antiforming agent, a photosensitizer, or a reaction diluent, as necessary.

Furthermore, in order to enhance the film-forming ability of the face surface treatment composite, the composite may contain a second hydrolyzable silane compound represented by the following Formula (2):

$$(R2)_{p2}Si(X')_{4-p2} \quad (2)$$

In Formula (2), R2 can be an alkyl group or an aryl group. These groups may be linear, branched, or cyclic or a combination thereof. More specifically, the alkyl group is, for example, a methyl group, an ethyl group, a propyl group, a butyl group, a hexyl group, a cyclohexyl group, an octyl group, a deuterated alkyl group, or a halogenated alkyl group and can be a hexyl group from the viewpoint of film-forming ability. The aryl group is, for example, a phenyl group, a tolyl group, a xylyl group, a naphthyl group, a biphenyl group, a deuterated aryl group, or a halogenated aryl group and can be a phenyl group from the viewpoint of film-forming ability. X' represents the same hydrolyzable group as X in Formula (1), and p2 represents an integer of 0 to 3 and can be 1.

Examples of the second hydrolyzable silane compound include tetramethoxysilane, tetraethoxysilane, tetrapropoxysilane, methyltrimethoxysilane, methytriethoxysilane, methyltripropoxysilane, ethyltrimethoxysilane, ethyltriethoxysilane, ethyltripropoxysilane, propyltrimethoxysilane, propyltriethoxysilane, propyltripropoxysilane, phenyltrimethoxysilane, phenyltriethoxysilane, phenyltripropoxysilane, diphenyldimethoxysilane, diphenyldiethoxysilane, dimethyldimethoxysilane, and dimethyldiethoxysilane.

Furthermore, in order to give higher hydrophobic characteristic, the composite may contain a third hydrolyzable silane compound represented by the following Formula (3):

$$(R3)_{p3}Si(X'')_{4-p3} \quad (3)$$

In Formula (3), R3 is an alkyl fluoride group, X" represents the same hydrolyzable group as X in Formula (1), and p3 represents an integer of 1 to 3 and can be 1.

Examples of the third hydrolyzable silane compound include pentafluoroethyl triethoxysilane, hexafluoropropyl triethoxysilane, and pentafluoroethyl trimethoxysilane. The third compound is important for expressing a hydrophobic characteristic. In the case of using such a compound, in the hydrophobic region, Si atoms form siloxane bonds via oxygen atoms, and some of Si atoms constituting the siloxane bonds bind with groups having fluorine atoms.

The hydrolyzable silane compounds represented by Formula (2) or (3) may be mixed with the hydrolyzable silane compound having cation polymerizable group(s) represented by Formula (1) to prepare a hydrolyzable silane compound solution, and then this hydrolyzable silane compound solution may be mixed other raw materials. In Examples described below, a hydrolyzable silane compound solution is thus prepared, followed by mixing with other raw materials to prepare a face surface treatment composite.

Preparation of Photocatalytic Particles Dispersion

In the process for adding and mixing the photocatalytic particles, a photocatalytic particles dispersion can be prepared in advance using a slight amount of a resin, a silane compound having a hydrolytic property, or the like. For example, when the photocatalytic particles are titanium oxide particles, a titanium oxide dispersion can be prepared by mixing titanium oxide particles and a proper solvent.

The titanium oxide dispersion may be a commercially available one. Examples of the commercially available titanium oxide dispersion include a hydrochloric acid deflocculation type anatase type titania sol (manufactured by Ishihara Sangyo Kaisha, Ltd., trade name: "STS-02" (average particle diameter: 7 nm), trade name: "ST-K01"), a nitric acid deflocculation type anatase type titania sol (manufactured by Nissan Chemical Industries, Ltd., trade name: "TA-15" (average particle diameter: 12 nm)), "Bistrator" (trade name, manufactured by Nippon Soda Co., Ltd.), "UC-100" (trade name, nano-titania coating agent, manufactured by Showa Denko K.K.), and "TKS-201", "TKS-202", "TKS-203", "TKD-701", and "TKD-702" (trade names, manufactured by Tayca Corp.).

A smaller particle diameter of the titanium oxide more effectively induces photocatalytic reaction, and the average particle diameter when measured by light scattering particle diameter measurement can be 50 nm or less and further 20 nm or less. A smaller diameter of the photocatalytic particles exhibits higher photo-patterning ability. Photocatalytic particles having a diameter greater than 200 nm induce light scattering, resulting in deterioration of photo-patterning ability.

Conditions for Hydrolysis of Hydrolyzable Silane Compound having Cation Polymerizable Group Conditions for hydrolysis or condensation of the hydrolyzable silane compound having cation polymerizable group(s) are not particularly limited. For example, it can be carried out by the following steps (1) to (3):

(1) a hydrolyzable silane compound having cation polymerizable group(s) (for example, a compound represented by Formula (1)) and a predetermined amount of water are placed in a container equipped with an agitator;

(2) subsequently, an organic solvent is further put in the container to give a mixture solution while the viscosity of the solution is regulated; and (3) the resulting mixture solution is stirred in air atmosphere at a temperature of from 0° C. to the boiling point of the organic solvent or the hydrolyzable silane compound having cation polymerizable group(s) for 1 to 24 hours. During the stirring, the mixture solution may be concentrated by distillation, or the displacement of the solvent may be carried out, as necessary.

In addition, a part of these hydrolyzable silane compounds having cation polymerizable group(s) is commercially available, and examples thereof include "KBM-303", "KBM-403", "KBE-402", and "KBE-403" (they are trade names) manufactured by Shin-Etsu Chemical Co., Ltd.

In the present invention, condensation of the hydrolyzable silane compound having cation polymerizable group(s) can be carried out simultaneously with hydrolysis by heating the compound in the presence of water. A desired degree of condensation can be achieved by properly regulating, for example, the temperature, time, and pH for the hydrolysis and condensation.

The degree of condensation can be also regulated by using a metal alkoxide as a catalyst for the hydrolysis. Examples of the metal alkoxide include aluminum alkoxide, titanium alkoxide, zirconium alkoxide, and complexes thereof (such as acetylacetone complex).

Photosensitizer

The face surface treatment composite may contain, in addition to the cationic photopolymerization initiator, a photosensitizer. The photosensitizer absorbs energy rays such as light and enhances the sensitivity of the cationic photopolymerization initiator. Examples of the photosensitizer include thioxanthone and thioxanthone derivatives such as diethyl thioxanthone; anthraquinone and anthraquinone derivatives such as bromoanthraquinone; anthracene and anthracene derivatives such as bromoanthracene; perylene and perylene derivatives; xanthene, thioxanthene, and derivatives thereof; and coumarin and ketocoumarin. Among these photosensitizers, diethyl thioxanthone and bromoanthracene can be more preferably used.

Reaction Diluent

By adding (blending) a reactive diluent to the face surface treatment composite, curing shrinkage of the resulting face surface treatment layer can be suppressed and the mechanical strength of the layer can be controlled. In particular, a cation polymerizable reactive diluent can adjust photo-reactivity and mechanical properties.

The reactive diluent can be a cation polymerizable monomer. The cation polymerizable monomer as a reactive diluent herein is an organic compound that induces polymerization or crosslinking reaction by light irradiation in the presence of a cationic photopolymerization initiator. Therefore, examples of the reactive diluent include epoxy compounds, oxetane compounds, oxolane compounds, cyclic acetal compounds, cyclic lactone compounds, thiirane compounds, thietane compounds, cyclic ether compounds such as spiroorthoester compounds, which are reaction products of epoxy compounds and lactone, cyclic thioether or vinyl compounds, and ethylene-based unsaturated compounds such as vinyl ether compounds. These cation polymerizable monomers can be used alone or in a combination of two or more.

Examples of the epoxy compound as the cation polymerizable monomer include bisphenol A diglycidyl ether, bisphenol F diglycidyl ether, and bisphenol S diglycidyl ether.

In particular, the cation polymerizable monomer can be an epoxy compound having two or more alicyclic epoxy groups in one molecule, such as 3,4-epoxycyclohexylmethyl-3',4'-epoxycyclohexane carboxylate and bis(3,4-epoxycyclohexylmethyl)adipate.

Application Method

The application of the face surface treatment composite can be carried out by, for example, spin coating, dipping, spraying, bar coating, roll coating, curtain coating, gravure printing, silk screening, or ink-jetting. Among these methods, the application can be preferably carried out by spin coating. Furthermore, in order to adjust the Theological properties of the face surface treatment composite so as to be suitable to the actual application method, various additives such as a leveling agent, a thixotropy-imparting agent, a filler, an organic solvent, or a surfactant can be blended as necessary.

The coating film formed by application of the face surface treatment composite is dried at a temperature of 50 to 90° C. and is further pre-baked, as necessary, by at 60 to 120° C. to be formed into a thin film (hereinafter, this thin film is referred to as a face surface treatment condensation film). The heating conditions for the pre-baking vary depending on, for example, the type and blending ratio of each component of the face surface treatment composite, but are usually a temperature of about 60 to 120° C. and a time of about 10 to 600 seconds.

The formed face surface treatment condensation film is cured by cationic polymerization induced by irradiation with light such as a radial ray. The radial ray herein can be, for example, visible light, UV light, infrared light, X-ray, α-ray, β-ray, or γ-ray. As described above, UV light can be preferably used. The method for irradiation with UV light is not particularly limited, and various methods can be used. For example, the light source may be a UV light source lamp such as a high-pressure mercury lamp, a low-pressure mercury lamp, a metal halide lamp, or an excimer lamp. The thin film can be irradiated with a radial ray having a wavelength of 200 to 390 nm and an illumination of 1 to 500 mW/cm$^2$ for a predetermined period of time such that the exposure dose is 10 to 5000 J/cm$^2$.

The irradiation of light such as a radial ray is carried out according to a predetermined pattern. Subsequently, the uncured unnecessary portion is removed by developing with a developer to form a face surface treatment film. The method for performing light irradiation according to a predetermined pattern is not limited to a method using a photomask having mask holes of a predetermined pattern. Example of other methods that can be used are a method for electrooptically forming a mask image composed of a radiolucent region and a radiopaque region according to a predetermined pattern by utilizing the same principle as that of a liquid crystal display; a method using an optical guiding member composed of a bundle of a large number of optical fibers and performing irradiation with a radial ray through the optical fibers corresponding to a predetermined pattern in the optical guiding member; and a method in which a face surface treatment condensation film is irradiated, while being scanned, with laser light or a convergent radial ray obtained from a light-harvesting optical system such as lens or mirror.

In the thin film selectively cured according to a predetermined pattern, the uncured portion can be removed, whereas the cured portion remains, by developing treatment with a proper organic solvent or an alkali developer by utilizing a difference in solubility of the cured and uncured portions. As a result, a predeterminedly patterned portion can be formed.

The cured film obtained by the radial ray irradiation may be further heated as necessary. The heating may be generally performed at a temperature of from room temperature to the kick-off temperature of a substrate or the thin film for, for example, 5 minutes to 72 hours. The further heating after the curing by radial ray irradiation can give a patterned portion that is excellent in hardness and heat resistance.

Schematic Description of Apparatus Body

Figure 4:
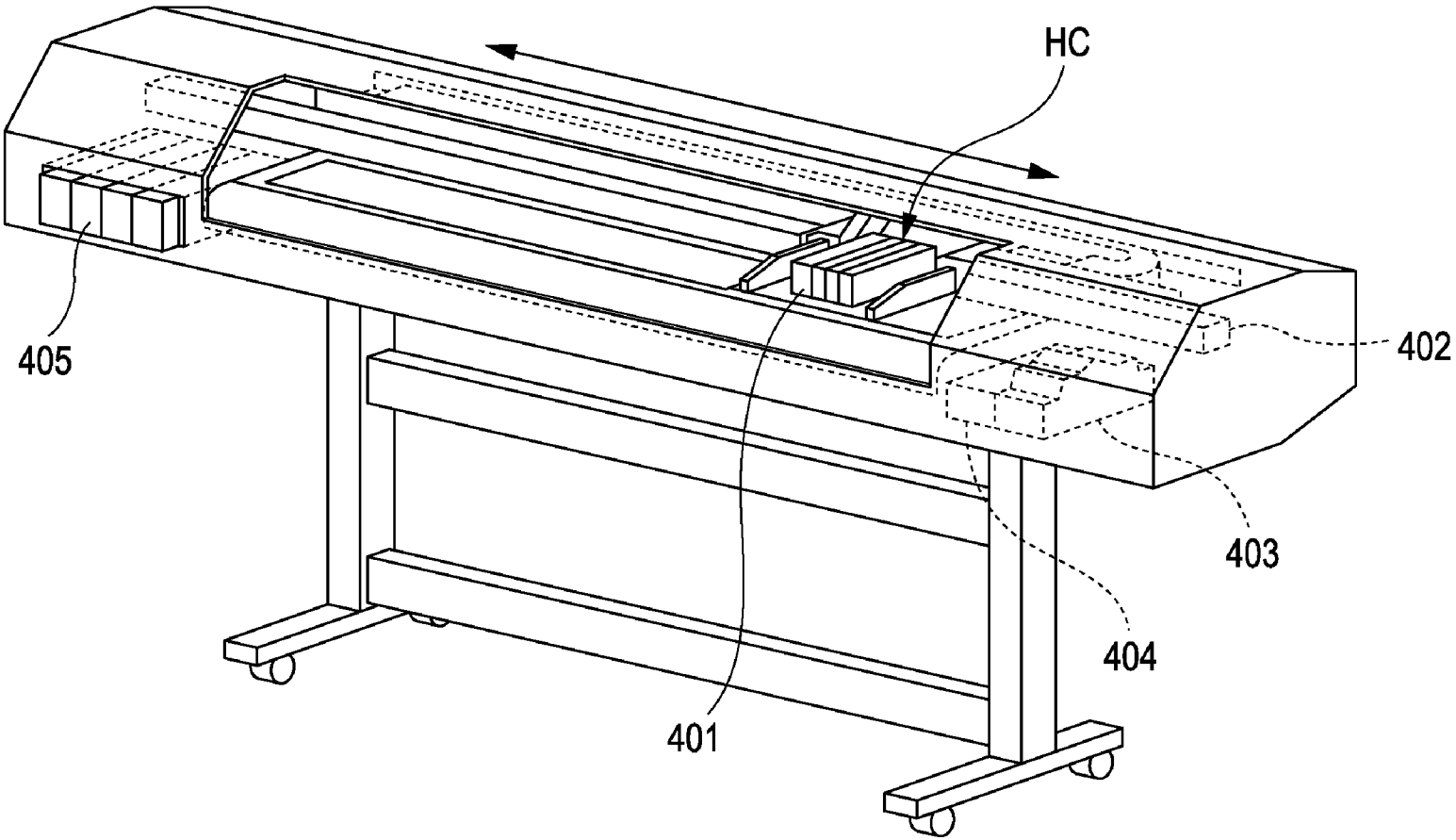
FIG. 4 is an appearance perspective view of a structural example of an ink-jet printer.

FIG. 4 is an appearance perspective view schematically illustrating an example of an ink-jet printer to which the IJ head according to the present invention can be applied. In FIG. 4, a carriage (HC) is held by a guide rail 405 and reciprocates in the direction indicated by an arrow. The carriage HC is loaded with an IJ head 401 to which ink is fed from ink tanks 404 by tube feeding. The apparatus is configured by loading a UV light irradiation device 402 and other components, as well as a recovery system 403 including a cleaning unit and a suction recovery unit for the recording head.

The UV light irradiation device activates photocatalytic particles (for example, titanium oxide) contained in the face surface treatment layer by UV light irradiation and decomposes substances adhering to the face surface. In addition, the suction recovery unit brings the face surface back to the initial state by suction recovery operation. Next, the UV lamp built in the IJ printer body will be described.

Any UV lamp that can activate titanium oxide, such as a metal halide lamp, a high-pressure or low-pressure mercury lamp, or an LED lamp, can be used, and a small-sized LED lamp can be preferably used. The IJ printer may have a lens for collecting light, a prism for guiding light, and a reflector, in addition to the lamp.

The UV light irradiation to the face surface may be properly conducted by a user of the printer or may be regularly conducted at the time that the frequency of use of the printer is low, such as late-night.

Even if the printer is used for a long time or the contact angle of the hydrophilic portion of the face surface varies by adhesion of ink component to the face surface, the catalytic particles of the face surface are activated by irradiating the face surface with UV light from the UV lamp built in the printer. This brings the face surface back to the initial state.

The present invention will be specifically described by Examples, but is not limited to these Examples.

Example 1

In this Example, a face surface treatment composite was prepared using titanium oxide as the photocatalytic particles, glycidoxypropyltriethoxysilane as the hydrolyzable silane compound having cation polymerizable group(s), and a sulfonium salt as the cationic photopolymerization initiator. The face surface treatment composite was applied to a face surface and was cured to produce an IJ head. A photosensitive resin material was used as the passage-forming composite. Both the face surface composite and the passage-forming composite had photo-patterning ability.

Hydrolyzable Silane Compound Solution A

Glycidoxypropyltriethoxysilane was used as the hydrolyzable silane compound having cation polymerizable group(s). In order to enhance the film-forming ability and the hydrophobic characteristic, methyltriethoxysilane and pentafluoroethyltriethoxysilane containing a fluorine group were added to the hydrolyzable silane compound solution. The following materials were stirred at room temperature and then heated to reflux for 24 hours to give hydrolyzable silane compound solution A. The degree of condensation of silane in the hydrolyzable silane compound solution A was measured by $^{29}$Si-NMR to be about 65%.

glycidoxypropyltriethoxysilane: 28 g (0.1 mol)

methyltriethoxysilane: 18 g (0.1 mol)

pentafluoroethyltriethoxysilane: 5.6 g (0.013 mol)

water: 21.6 g ethanol: 27 g

Titanium Oxide Dispersion A

Titanium oxide was used as the photocatalytic particles. A titanium oxide dispersion (trade name: TKD-701, manufactured by Tayca Corp.) was diluted with methylisobutylketone (hereinafter, abbreviated to MIBK) to 50 mass % to prepare titanium oxide dispersion A. Cationic photopolymerization initiator dispersion A A sulfonium salt (trade name: Adeka Optomer SP172, manufactured by ADEKA Corp.) was used as the cationic photopolymerization initiator. The sulfonium salt was diluted with MIBK to 50 mass % to prepare cationic photopolymerization initiator dispersion A.

Face Surface Treatment Composite A

The above-prepared hydrolyzable silane compound solution A, titanium oxide dispersion A, and cationic photopolymerization initiator dispersion A were mixed according to the following composite and were stirred to give face surface treatment composite A.

titanium oxide dispersion A: 50 g hydrolyzable silane compound solution A: 50 g cationic photopolymerization initiator dispersion A: 6 g Passage-Forming Composite A The following materials were mixed and stirred (at ambient temperature for one to three hours) to prepare passage-forming composite A. The photo-polymerization catalyst used in passage-forming composite A is a material having the same function as that of the cationic photopolymerization initiator.

epoxy resin (trade name: EHPE3150, manufactured by Daicel Chemical Industries, Ltd.): 100 g 1,4HFAB (trade name, manufactured by Central Glass Co., Ltd.): 20 g sulfonium salt (photo-polymerization catalyst) (trade name: Adeka Optomer SP172, manufactured by ADEKA Corp.): 1 g MIBK: 78 g Production of Evaluation Pattern An evaluation pattern was produced by the process shown in FIGS. 6A to 6F.

Figure 6A:
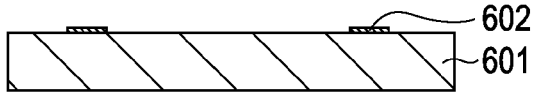
FIGS. 6A to 6F are diagrams illustrating a process for producing an evaluation pattern.
Figure 6B:
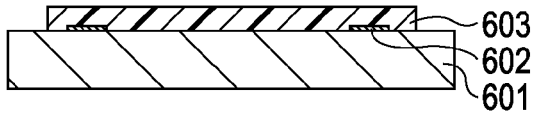

First, energy-generating elements 602 are provided on a substrate 601 at predetermined positions (FIG. 6A), and a predetermined ink passage pattern 603 composed of a soluble resin was formed on the substrate 601 (FIG. 6B). The soluble resin may be, for example, a positive-type resist such as isopropenylketone.

Figure 6C:
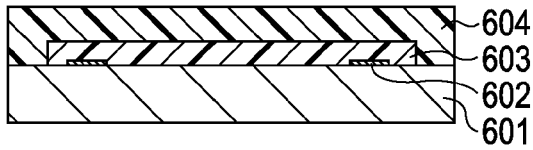

Subsequently, the prepared passage-forming composite A having photosensitivity was applied on the ink passage pattern 603 by spin coating and subjected to pre-baking at 90° C. for four minutes to form a passage-forming coating film 604 (FIG. 6C). The application and the pre-baking were each conducted twice.

Figure 6D:
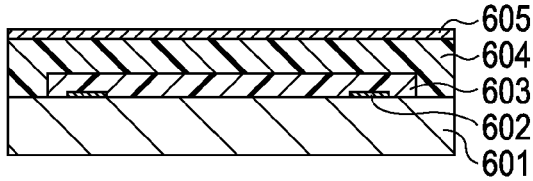
Figure 6E:
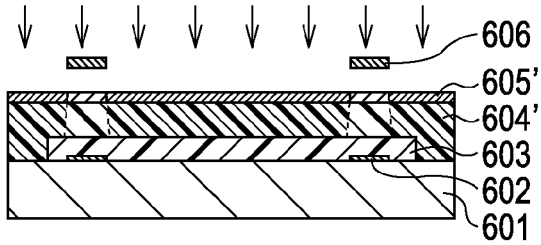
Figure 6F:
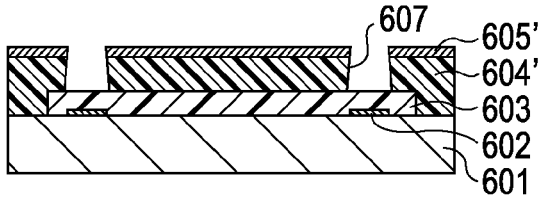

Then, face surface treatment composite A was applied on the passage-forming coating film 604 by spin coating and pre-baked at 90° C. for one minute to form a face surface treatment condensation film 605 (FIG. 6D). The total thickness of the passage-forming coating film 604 and the face surface treatment layer 605 on the ink passage pattern 603 was 45 μm.

Then, pattern exposure of ink ejection orifices was carried out using a photomask 606 and a mask aligner "MPA600 super" (trade name, manufactured by CANON KABUSHIKI KAISHA). The exposure dose was 150 mJ/cm$^2$.

Then, ejection orifices 607, a passage-forming layer 604', and a face surface treatment layer 605' were formed by post-baking at 90° C. for four minutes, development with MIBK, and a rinse with isopropyl alcohol. The produced IJ head was left to stand for a while. The face surface treatment layer 605' formed in this step had a hydrophobic characteristic.

Figure 7A:
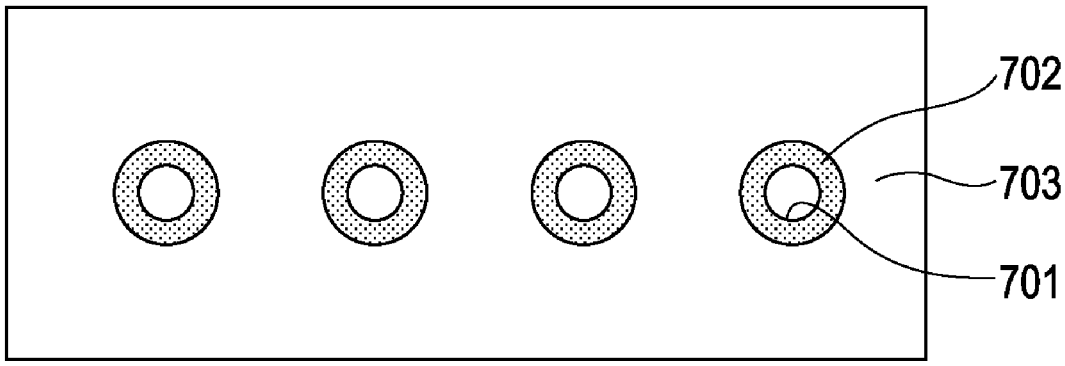
FIGS. 7A and 7B are schematic diagrams illustrating face surfaces of ejection orifices.

As the last step, though it is not shown in the drawing, in order to form hydrophilic regions (lyophilic portions 702) on the face surface, the face surface was irradiated with UV light (Hamamatsu Photonics LC5, wavelength: 365 nm, 100 mW) using photomask A (not shown) for 20 minutes to form a face surface treatment layer that included, as shown in FIG. 7A, lyophilic portions 702 having a hydrophilic characteristic and surrounding the ejection orifices 701 and a lyophobic portion 703 having a hydrophobic characteristic. In addition, as described above, titanium oxide as the photocatalytic particles was activated by the UV light irradiation to impart a hydrophilic characteristic to the irradiated portion.

Example 2

Figure 7B:
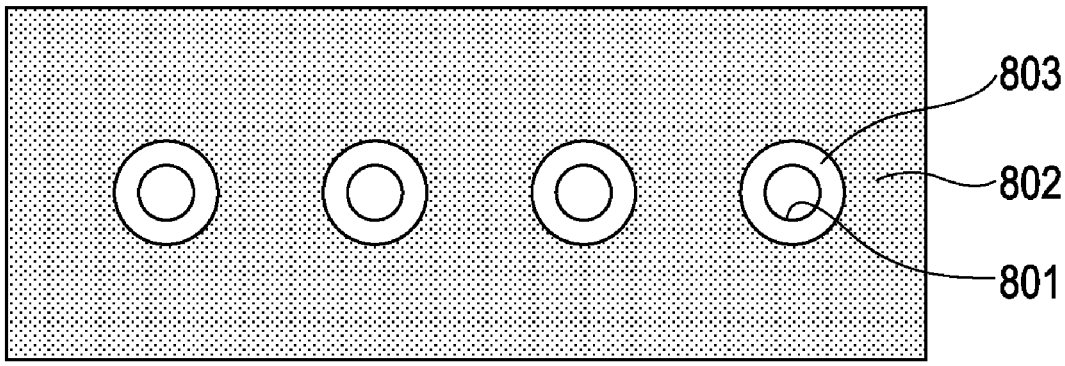

An evaluation pattern was produced as in Example 1 except that photomask B (not shown) was used. By treating the face surface treatment layer 605' using photomask B, a face surface treatment layer that included, as shown in FIG. 7B, lyophobic portions 803 having a hydrophobic characteristic and surrounding the ejection orifices 801 and a lyophilic portion 802 having a hydrophilic characteristic at the area other than the lyophobic portions 803.

Example 3

An evaluation pattern was produced as in Example 1 except that the UV light irradiation in the last step was not carried out. That is, the entire surface of the face surface treatment layer was the hydrophobic region.

Example 4

In this Example, an evaluation pattern was produced as in Example 1 except that the following face surface treatment composite B was used.

Hydrolyzable Silane Compound Solution B

The following materials were stirred at room temperature and then heated to reflux for 24 hours to give hydrolyzable silane compound solution B. The degree of condensation of silane was measured by $^{29}$Si—NMR to be about 69%.

methyltriethoxysilane: 36 g (0.2 mol)

pentafluoroethyltriethoxysilane: 5.6 g (0.013 mol)

water: 21.6 g ethanol: 37 g

Preparation of Face Surface Treatment Composite B

Face surface treatment composite B was prepared by stirring a composite containing the followings:

titanium oxide dispersion A: 50 g, hydrolyzable silane compound solution B: 50 g, and cationic photopolymerization initiator dispersion A: 6 g.

As in Example 1, the evaluation pattern was irradiated with UV light for 20 minutes using photomask A.

Example 5

Face surface treatment composite C was prepared using the following titanium oxide dispersion B instead of titanium oxide dispersion A, and an evaluation pattern was produced as in Example 1 except that the following face surface treatment composite C was used instead of face surface treatment composite A. The thickness was 40 μm.

Titanium Oxide Dispersion B

The following materials were weighed and stirred with a homogenizer at 100 Hz for two hours to give titanium oxide dispersion B.

titanium oxide (trade name: P25, manufactured by Nippon Aerosil Co., Ltd.): 10 g titanium coupling agent (trade name: 338X, manufactured by Ajinomoto Fine-Techno Co., Inc.): 2.3 g glycidylpropyltriethoxysilane: 2 g MIBK: 70 g Face Surface Treatment Composite C Face surface treatment composite C was prepared by stirring a composite containing the followings:

passage-forming composite A: 100 g, and titanium oxide dispersion B: 100 g.

The surface of the resulting evaluation pattern was treated with oxygen plasma to etch the epoxy resin covering the titanium oxide surface, so that titanium oxide was exposed.

Example 6

An evaluation pattern was produced as in Example 1 except that the following passage-forming composite B was used instead of passage-forming composite A and that the UV light irradiation in the last step was performed without a photomask. By performing the UV light irradiation without a photomask, the entire surface of the face surface treatment layer was hydrophilic. The thickness was 35 μm.

Passage-Forming Composite B epoxy resin (trade name: EHPE3150, manufactured by Daicel Chemical Industries, Ltd.): 100 g 1,4HFAB (manufactured by Central Glass Co., Ltd.): 20 g photo-polymerization catalyst (trade name: "SP172", manufactured by ADEKA Corp.): 1 g MIBK: 78 g Example 7

Titanium Oxide Dispersion C

Figure 3A:
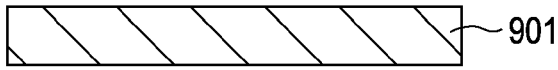
FIGS. 3A to 3G are diagrams illustrating a process for producing a pattern according to the present invention.
Figure 3B:
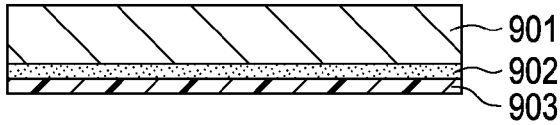

The following materials were weighed and stirred with a homogenizer at 100 Hz for two hours to give titanium oxide dispersion C.

titanium oxide (trade name: P25, manufactured by Nippon Aerosil Co., Ltd.): 10 g hexyltriethoxysilane: 2.3 g glycidylpropyltriethoxysilane: 2 g ethanol: 70 g water: 15.7 g Face Surface Treatment Composite D passage-forming composite A: 100 g titanium oxide dispersion C: 100 g Production of Evaluation Pattern An evaluation pattern was produced according to the process shown in FIGS. 3A to 3G. First, Aramica (registered trademark) film (para-aramid film having an extremely small thickness, high heat resistance, and a low thermal expansion characteristic) having a thickness of 25 μm manufactured by Teijin Advanced Films Limited was used as a base material 901 (FIG. 3A). The bottom surface of the base material 901 was provided with an adhesive layer 902, which is used in a post-step, and a sacrificial layer (polyvinyl alcohol) 903 for preventing decomposition products from adhesion during perforation working (FIG. 3B).

Figure 3C:
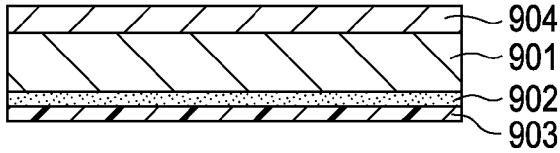

Subsequently, face surface treatment composite D was applied to the top surface of the base material 901 with a roll coater and was dried to form a face surface treatment condensation film 904. The thickness was about 1 μm (FIG. 3C).

Figure 3D:
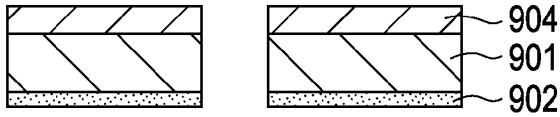

Then, ejection orifices 907 for an ink-jet orifice plate were perforated in the face surface treatment condensation film 904, and the sacrificial layer 903 at the bottom surface was removed by dissolution (FIG. 3D). The perforation of the ejection orifices was performed using an excimer laser of 254 nm, and nozzles each having an opening size of 20 μm ϕ were formed at a pitch of 180 nozzles per inch (about 2.5 cm) over one inch.

Figure 3E:
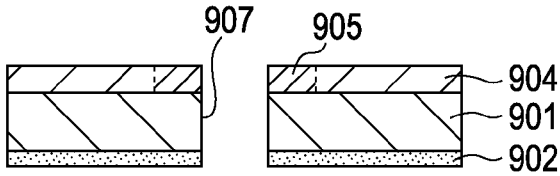

Subsequently, the face surface treatment condensation film 904 was provided with a desired mask, and the region other than the masked portion was pattern-exposed using a mask aligner "MPA600 super" manufactured by CANON KABUSHIKI KAISHA (FIG. 3E). In FIG. 3E, the exposure region was cured by polymerization of the cation polymerizable groups contained in the face surface treatment condensation film 904 to become a face surface treatment layer 905.

Figure 3F:
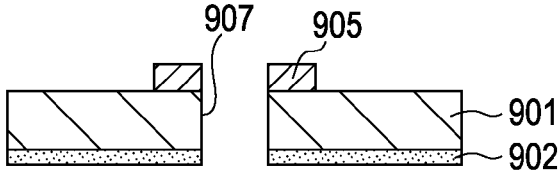

Then, the face surface treatment condensation film 904 was removed by development with MIBK (FIG. 3F). Furthermore, curing treatment was performed at 130° C. for one hour.

Figure 3G:
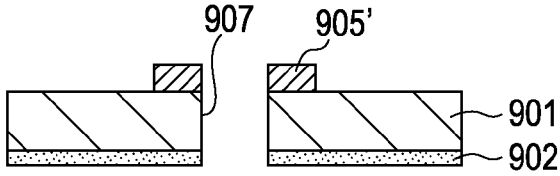

Then, the face surface treatment layer 905 was irradiated with UV light for 20 minutes. This treatment activated the titanium oxide photocatalyst contained in the face surface treatment layer 905 having a hydrophobic characteristic, and thereby the face surface treatment layer 905 was changed to a face surface treatment layer 905' having a hydrophilic characteristic (FIG. 3G).

Evaluation of Evaluation Pattern

The evaluation patterns produced in Examples 1 to 7 were evaluated for their contact angles, photo-patterning ability, and blade resistance.

Measurement of Contact Angle

The contact angle is generally used as a measure for evaluating surface status of a material. FIG. 1 is a diagram illustrating a concept of a contact angle θ of Young, and there is a relationship: $Y_S = Y_{SL} + Y_L \cos\theta$. In the expression, $Y_S$ represents the surface tension of a solid, $Y_{SL}$ represents the solid-liquid interfacial tension, and $Y_L$ represents the surface tension of a liquid.

Therefore, the contact angle θ depends on the surface tension $Y_L$ of a liquid. In the case of using water as the liquid, the maximum contact angle θ that is supposed from the surface tension is 110°.

The face surface of an IJ head is required to have a hydrophilic characteristic or a hydrophobic characteristic for stably maintain the meniscus. However, when the face surface is in contact with ink for a long time, fine substances adhere to the surface to change the hydrophobic characteristic or the hydrophilic characteristic, resulting in a variation in the contact angle. Since the variation in the contact angle closely links to the condition of the meniscus, the measurement of a contact angle is particularly effective for evaluating the durability of a face surface treatment layer. In addition, titanium oxide irradiated with UV light exhibits a hydrophilic characteristic with a contact angle of 20° or less, but the portion unirradiated with UV light exhibits a hydrophobic characteristic with a contact angle of 90° or more.

The evaluation patterns produced in Examples were irradiated with UV light under the above-mentioned conditions. Then, the portions irradiated with UV light were measured for contact angles for water. Specifically, the patterns were immersed in BCI7Cyan ink (trade name, manufactured by CANON KABUSHIKI KAISHA) at 60° C. for four weeks and then washed with pure water. The patterns were irradiated with UV light (Hamamatsu Photonics LC5, wavelength: 365 nm, 100 mW) for ten minutes, and then the contact angles were measured again. The measurement was performed with a contact angle meter, CA-X150, manufactured by Kyowa Interface Science Co., Ltd. for the contact angles for water drops.

The evaluation criteria for contact angles are as follows:

Excellent: the contact angle after immersion in ink is 15° or less and a variation in the contact angle (between before and after storage at 60° C.) is 50 or less;

Good: the contact angle after immersion in ink is 20° or less and a variation in the contact angle is 10° or less; and Fair: the contact angle after immersion in ink is greater than 20° and a variation in the contact angle is greater than 10°.

Photo-Patterning Ability

The evaluation patterns after exposure and development were observed by a metal microscope to confirm the pattern accuracy.

The evaluation criteria for photo-patterning ability are as follows:

Good: no cracking is observed around ejection orifices; and

Poor: no patterning of ejection orifices is produced.

Table 1 shows the face surface composite and photomask used for producing the evaluation pattern in each Example and shows the evaluation results.

TABLE 1

| | Face surface treatment composite | Photomask | Variation in contact angle | Photo-patterning ability |
|---|---|---|---|---|
| Example 1 | A | A | Excellent | Excellent |
| Example 2 | A | B | Excellent | Excellent |
| Example 3 | A | No UV light irradiation | Excellent | Excellent |
| Example 4 | B | A | Excellent | Good |
| Example 5 | C | A | Good | Excellent |

TABLE 1-continued

| | Face surface treatment composite | Photomask | Variation in contact angle | Photo-patterning ability |
|---|---|---|---|---|
| Example 6 | A | None | Excellent | Excellent |
| Example 7 | D | No UV light irradiation | Excellent | Excellent |

Example 8

In this Example, an ink-jet recording head was produced using passage-forming composite A and face surface treatment composite A described in Example 1 according to the process shown in FIGS. 2A to 2L.

Figure 2A:
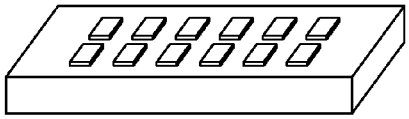
FIGS. 2A to 2L are diagrams illustrating each step in an exemplary process for producing an ink-jet recording head according to the present invention.
Figure 2B:
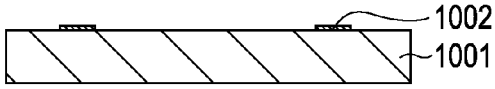

First, a silicon substrate 1001 provided with electrothermal conversion elements as ink ejection pressure generating elements 1002 was prepared (FIGS. 2A and 2B).

Figure 2C:
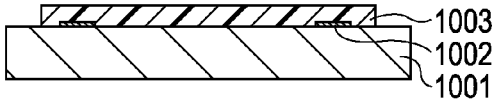
Figure 2D:
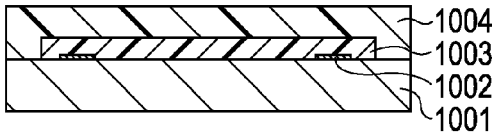

Subsequently, polymethylisopropenylketone (manufactured by Tokyo Ohka Kogyo Co., Ltd., ODUR-1010), as a soluble resin material, applied to the silicon substrate 1001 by spin coating. Then, after pre-baking at 120° C. for six minutes, ink passages were pattern-exposed using a mask aligner UX3000 manufactured by Ushio Inc. for three minutes. Then, development with methylisobutylketone/xylene=2/1 and a rinse with xylene were performed to form an ink passage pattern 1003 (FIG. 2C). The polymethylisopropenylketone is a so-called positive-type resist, which is decomposed by UV light irradiation to become soluble to an organic solvent. The ink passage pattern 1003 was formed for securing ink passages for feeding ink at the portion that was not subjected to the pattern exposure. The thickness of the ink passage pattern after the exposure was 20 μm.

Figure 2E:
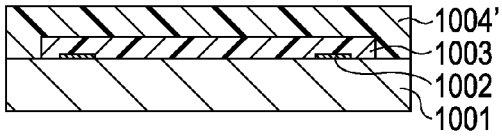
Figure 2F:
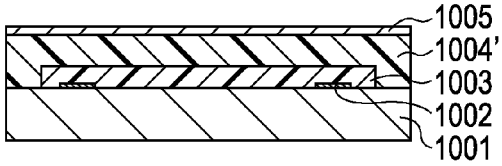

Subsequently, passage-forming composite A (photo-curable) was applied onto the ink passage pattern 1003 formed of the soluble resin layer by spin coating to form a passage-forming coating film 1004 (FIG. 2D), followed by pre-baking at 90° C. for four minutes to change the passage-forming coating film 1004 to a passage-forming condensation film 1004' (FIG. 2E). The application and the pre-baking were each conducted twice.

Figure 2G:
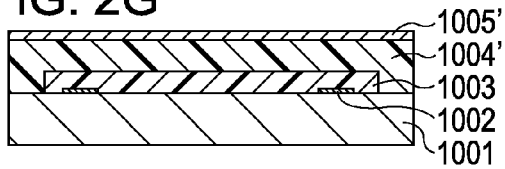
Figure 2H:
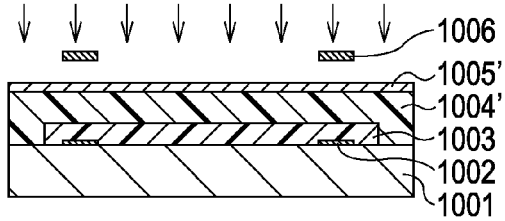
Figure 2I:
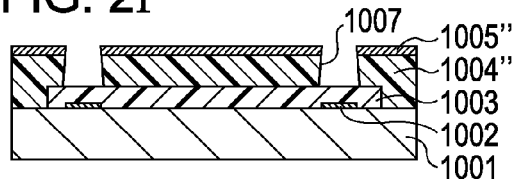
Figure 2J:
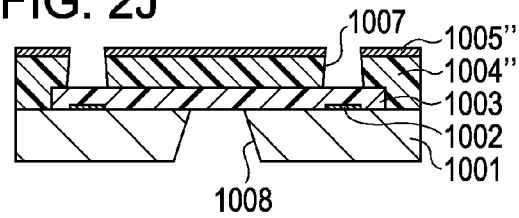

Then, similarly, face surface treatment composite A was applied onto the passage-forming condensation film 1004' by spin coating, followed by pre-baking at 90° C. for one minute to form a face surface treatment condensation film 1005' (FIG. 2G). The total thickness of the face surface treatment condensation film 1005' and the passage-forming condensation film 1004' on the ink passage pattern 1003 was 45 μm.

Subsequently, pattern exposure of ink ejection orifices was carried out using a photomask 1006 and a mask aligner "MPA600 super" manufactured by CANON KABUSHIKI KAISHA.

Then, ejection orifices 1007, a face surface treatment layer 1005", and a passage-forming layer 1004" were formed by heating at 90° C. for four minutes, development with methylisobutylketone (MIBK), and a rinse with isopropyl alcohol. By this way, the ejection orifices 1007 can have a sharp pattern-edge shape.

Subsequently, a mask for forming ink-feeding openings was properly disposed on the rear face of the substrate 1001, and ink-feeding openings 1008 were formed by anisotropic etching of the silicon substrate. The silicon was anisotropically etched while the surface of the substrate provided with the passages was protected with a rubber protecting film.

Figure 2K:
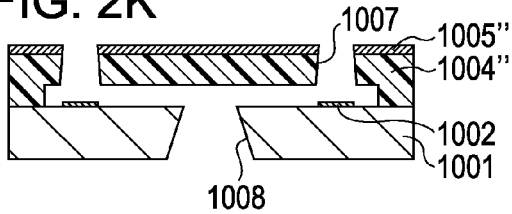

Then, after the completion of the anisotropic etching, the rubber protection film was removed. Furthermore, the whole area was irradiated with UV light again using the UX3000 for decomposing the soluble resin layer constituting the ink passage pattern 1003. Then, the substrate was immersed in methyl lactate for one hour, while being sonicated, for liquating out the ink passage pattern 1003 to form the passages (FIG. 2K).

Then, in order to completely cure the resin, heating treatment was performed at 200° C. for one hour. Lastly, an ink-feeding member (not shown) was coupled to the ink-feeding openings to produce an IJ head.

Figure 2L:
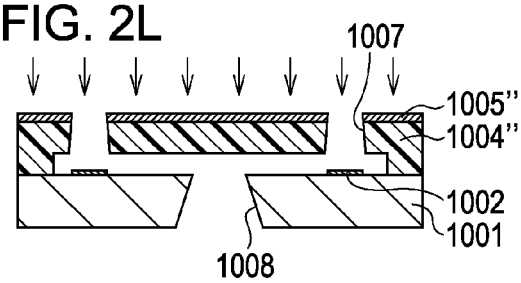

The produced IJ head can impart a hydrophilic characteristic to the face surface treatment layer thereof by UV light irradiation (FIG. 2L).

Blade Durability

The IJ head produced in this Example was installed to a printer. Blade scraping evaluation by suction recovery was repeated, and then the face surface was observed by an SEM to confirm there was no large difference from the initial state.

Example 9

This Example relates to a process for producing an evaluation pattern having a photocatalyst layer around the ejection orifices. FIGS. 5A to 5F are process diagrams illustrating the process.

Figure 5A:
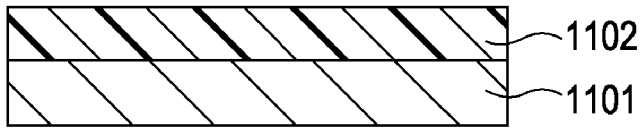
FIGS. 5A to 5F are diagrams illustrating a production process in Example 9.
Figure 5B:
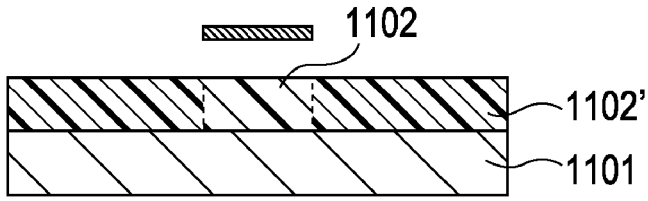

First, a photosensitive resin composite was applied onto a substrate 1101 consisting of a silicon wafer and pre-baked at 95° C. to form a photosensitive resin layer 1102 (FIG. 5A). The photosensitive resin composite used was "SU-8 4025" (trade name, manufactured by MicroChem Corp.), which is an epoxy-based thick photopolymer film containing a photoacid-generating agent and having cation-polymerizing ability. The photosensitive resin layer 1102 had a thickness of 25 μm. The application was conducted with a precision spray.

Subsequently, pattern exposure was performed with a mask having circular nozzle holes having a diameter of 20 μm at a pitch of 42.3 μm (600 dpi) using a mask aligner "MPA600 super" manufactured by CANON KABUSHIKI KAISHA (FIG. 5B) to give an exposed photosensitive resin layer 1102'.

Figure 5C:
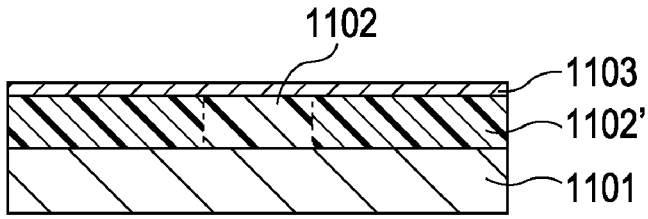

After the exposure, without performing development, the face surface treatment composite according to the present invention was applied onto the photosensitive resin layers 1102 and 1102' with a spinner and was dried (FIG. 5C). This layer, after drying, had a thickness of about 2 μm.

Figure 5D:
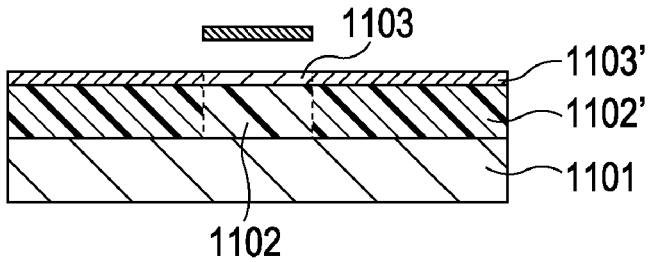

Then, pattern exposure was performed from the above of the layer formed on the thus prepared wafer with a mask having circular nozzle holes with a diameter of 20 μm and using a mask aligner "MPA600 super" manufactured by CANON KABUSHIKI KAISHA (FIG. 5D).

Figure 5E:
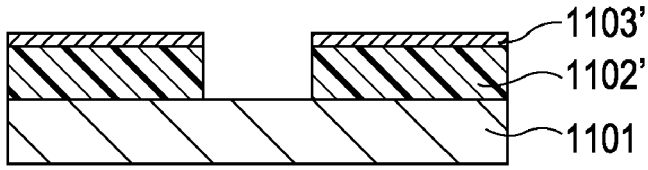
Figure 5F:
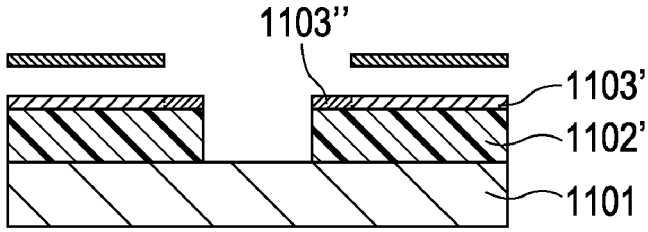

Then, development was performed with a solvent mixture of xylene and IPA, followed by post-baking at 120° C. for 30 minutes to form nozzle holes having a cross-sectional shape shown in FIG. 5E.

Then, in order to activate the exo-edges of the nozzle holes for imparting a hydrophilic characteristic thereto, regions surrounding the nozzle holes were irradiated with UV light for 20 minutes using a nozzle mask having holes with a diameter of 31 μm ϕ.

By this way, the outer surface of the ink-jet nozzle holes formed by photolithography can be treated such that hydrophilic regions 1103" surround the nozzles and a hydrophobic region 1103' extends so as to surround the hydrophilic regions 1103" (FIG. 5G).

In the description above, a hydrophobic portion was first formed, and then the hydrophobic portion was partially changed to be hydrophilic, but it is possible to partially form hydrophilic portions and then form hydrophobic portions.

The method of hydrophobization and hydrophilization of the present invention can be also applied to, for example, coating films for electronics, structures, mirror, office supplies, automobile parts, and buildings.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese patent application No. 2008-178988 filed Jul. 9, 2008, which is hereby incorporated by reference herein in its entirety.

What is claimed is:

1. A process for producing a liquid ejection head having an ejection orifice member provided with ejection orifices for ejecting liquid, the process comprising:

supplying to a surface of a base material for forming the ejection orifice member a mixture of a first composite for imparting a hydrophobic characteristic to the surface and a second composite being able to exhibit a hydrophilic characteristic by being irradiated with light;

imparting a hydrophobic characteristic to the surface by utilizing the first composite; and irradiating the second composite with light in a region of the surface provided with the hydrophobic characteristic for imparting a hydrophilic characteristic to the region irradiated with the light.

2. The process according to claim 1, wherein the first composite contains a siloxane compound including a group having a fluorine atom and a group having a polymerizable group and a polymerization initiator.

3. The process according to claim 1, wherein the second composite contains a compound selected from the group consisting of titanium oxide, zinc oxide, tungsten oxide, iron oxide, and strontium titanate; and the compound is activated by irradiation with light.

4. The process according to claim 2, wherein the first composite is irradiated with light; and then the siloxane compound is polymerized utilizing the group having a polymerizable group.

5. The process according to claim 1, wherein the surface provided with the hydrophobic characteristic has a contact angle for water of 90° or more; and the surface provided with the hydrophilic characteristic has a contact angle for water of 20° or less.

6. A liquid ejection head comprising:

an ejection orifice member provided with ejection orifices for ejecting liquid, wherein a face in which the ejection orifices of the ejection orifice member are opened includes a portion where Si atoms binding to groups having fluorine atoms form a siloxane bond via an oxygen atom and a portion where Ti atoms binding to hydroxyl groups bind to each other via an oxygen atom.

7. The liquid ejection head according to claim 6, wherein the portion where Ti atoms binding to hydroxyl groups bind to each other via an oxygen atom is included in the portion where Si atoms binding to groups having fluorine atoms form a siloxane bond via an oxygen atom.

* * * * *